United States Patent [19]

Lebeau et al.

[11] 4,374,703

[45] Feb. 22, 1983

[54] CONTROL SYSTEM FOR PAPERMAKING MACHINE HEADBOX

[75] Inventors: Louis Lebeau; Guy Bornard, both of Saint-Ismier, France

[73] Assignee: Centre Technique de l'Industrie des Papiers, Cartons et Celluloses, Grenoble, France

[21] Appl. No.: 223,564

[22] Filed: Jan. 8, 1981

Related U.S. Application Data

[63] Continuation of Ser. No. 52,216, Jun. 26, 1979, abandoned.

[30] Foreign Application Priority Data

Jun. 30, 1978 [FR] France ..... 78 20428

[51] Int. Cl.[3] ..... D21F 1/02; D21F 1/06

[52] U.S. Cl. ..... 162/253; 162/256; 162/259; 162/262; 162/263; 162/DIG. 6; 162/DIG. 11; 364/471; 364/568

[58] Field of Search ..... 162/253, 259, 258, 256, 162/DIG. 11, 262, DIG. 6, 198, 263; 364/471, 568

[56] References Cited

U.S. PATENT DOCUMENTS 3,703,436 11/1972 Rice ..... 162/259

3,886,036 5/1975 Dahlin ..... 162/259

OTHER PUBLICATIONS

Sidebottom, "Computer Control of Paper Making Plant", *IEEE,* vol. 116, No. 10, Oct., 1969, pp. 1755–1758.

Fellows, "Multi-Loop Anticipator Computer Control Systems", *The Paper Industry,* May, 1963.

"A Low-Cost Paper Machine Wet End System", The Paper Maker, Aug., 1966.

Talvio, "A Study Of Paper Machine Headbox Control System With Linear Transfer Functions", Congres. IFAC, 1966.

*Primary Examiner*—Steve Alvo

*Attorney, Agent, or Firm*—Stevens, Davis, Miller & Mosher

[57] ABSTRACT

A system for the control of a paper machine headbox having sensors for the measurement of the parameters of the process and actuators of the members of the process, functionally connecting at least most of the sensors to an at least equal number of actuators via a multivariable centralized control member which makes it possible to control each actuator by the taking into account and processing of the measurement information of one or more sensors, and causing the measurement information to act on each of the sensors functionally connected to the actuators on one or more members to obtain a resultant action in which only the parameter measured by this sensor is influenced while the secondary repercussions on the outer parameters are eliminated. Another characteristic, the invention permits rapid intervention taking into account the information on the substance flow rate at the headbox, eliminating the usual disturbing influences due to the hydraulic values of the process.

12 Claims, 14 Drawing Figures

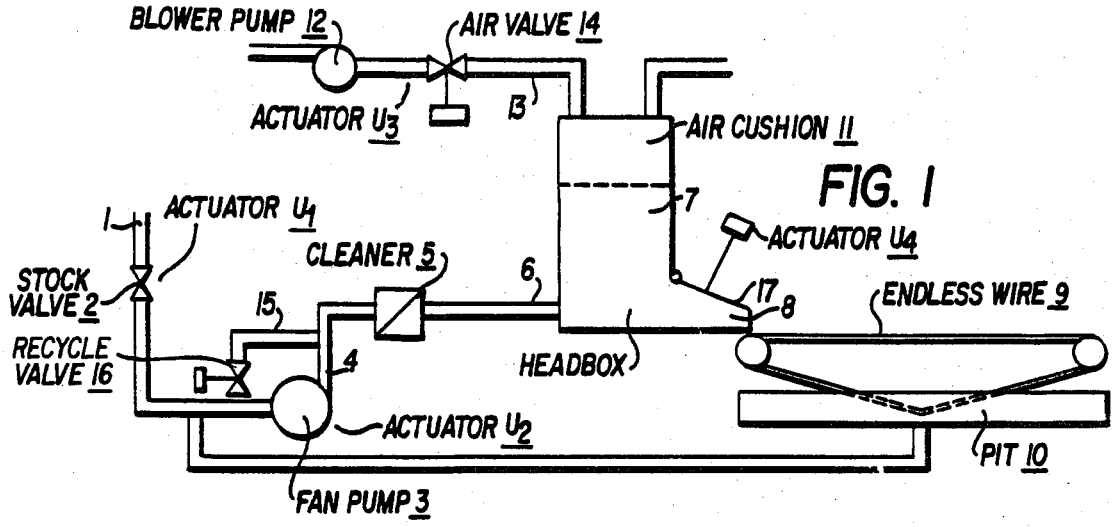
FIG. 1
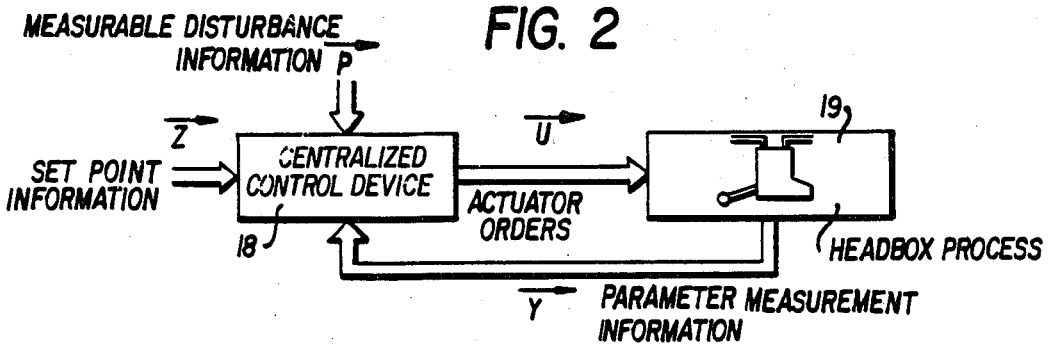
FIG. 2
FIG. 3
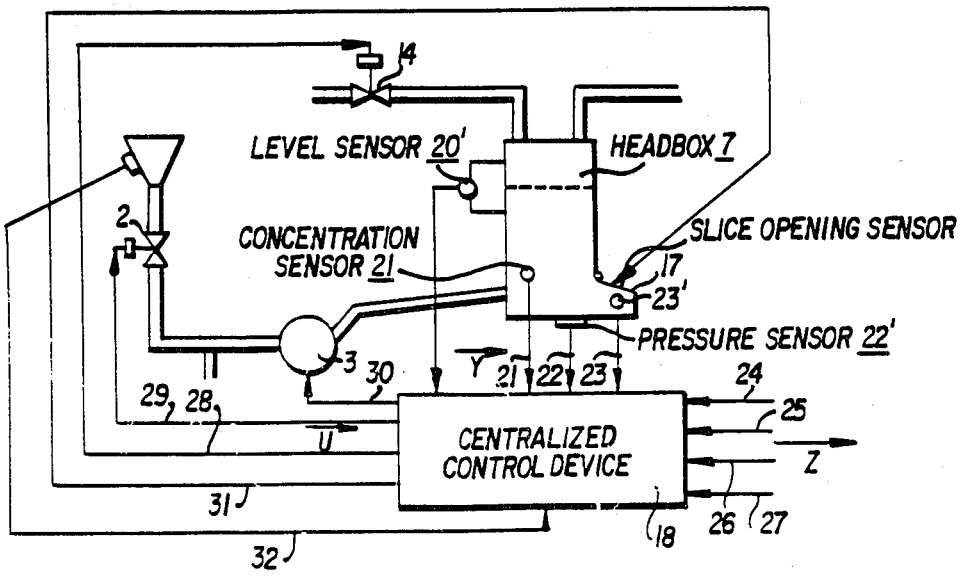

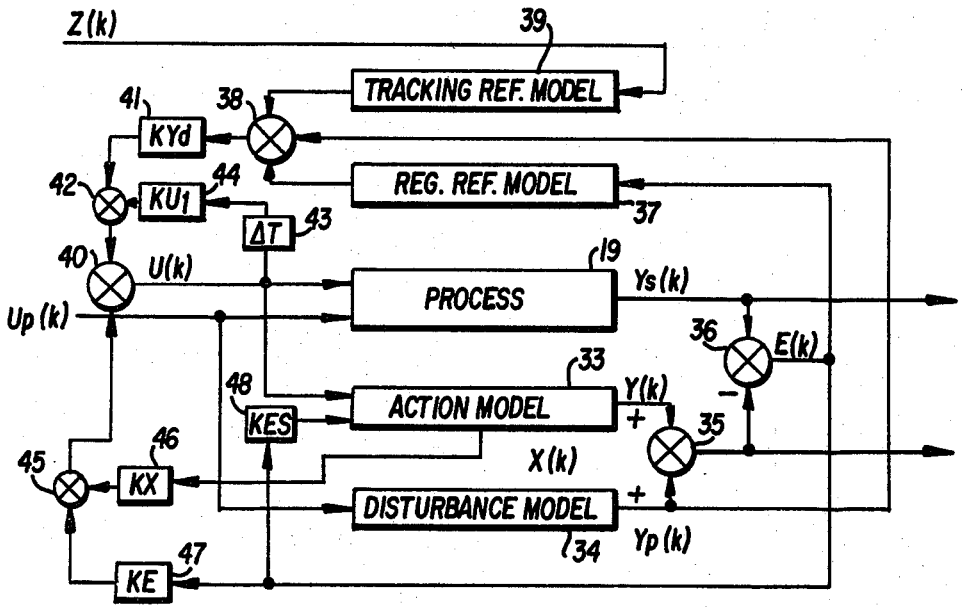
FIG. 4
FIG. 5
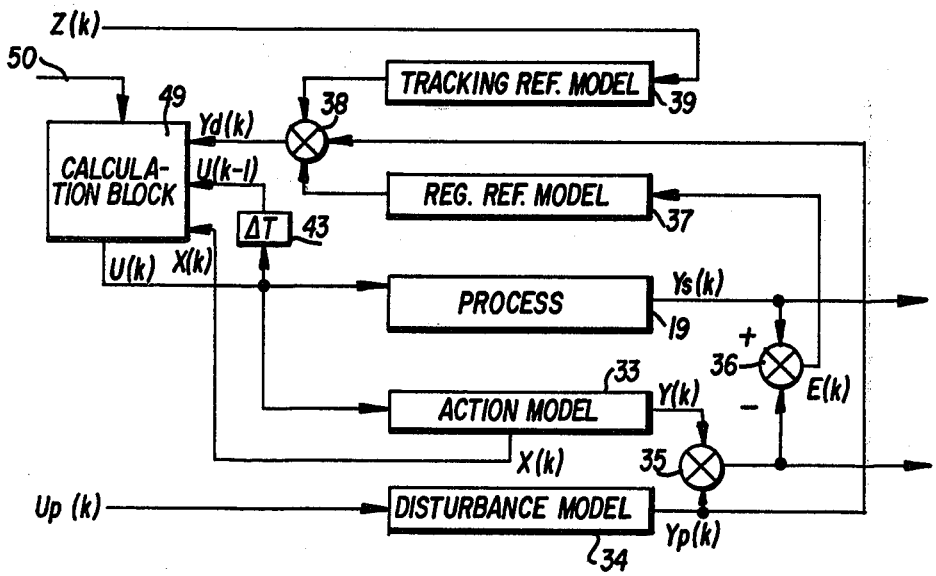

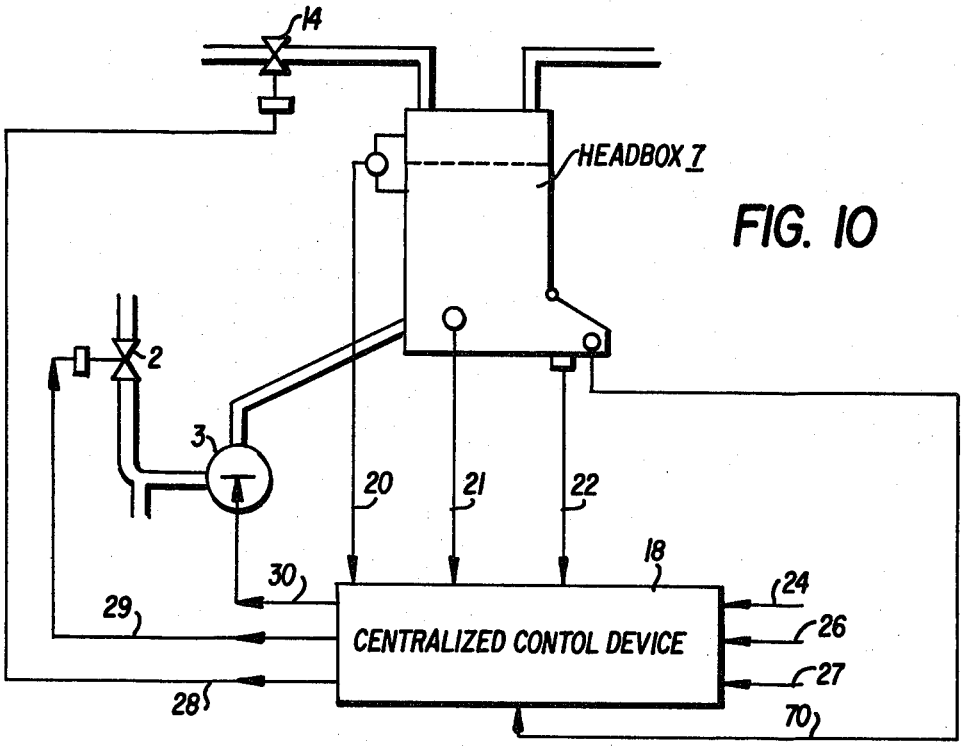
FIG. 10
FIG. 11
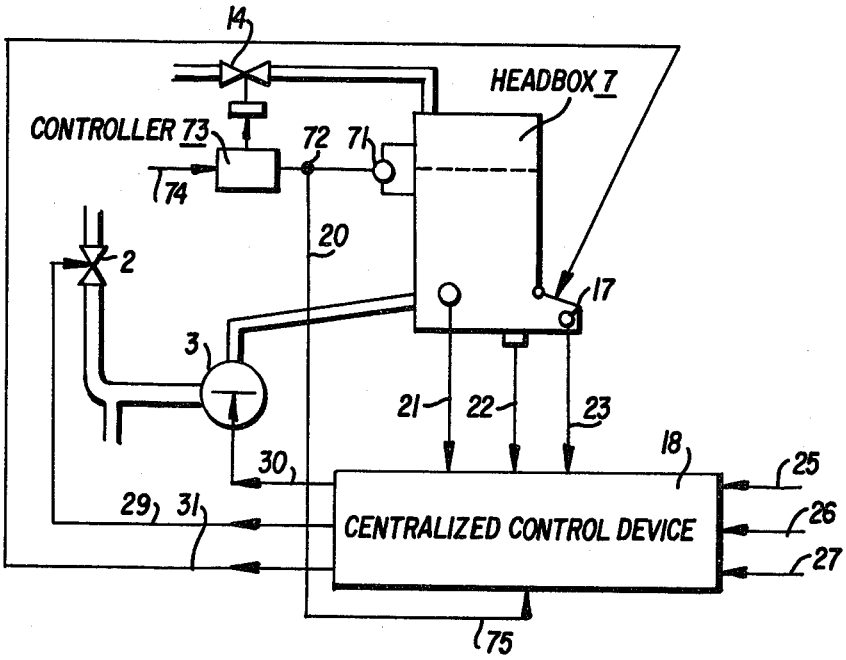

CONTROL SYSTEM FOR PAPERMAKING MACHINE HEADBOX

This is a continuation of application Ser. No. 52,216 filed June 26, 1979, now abandoned.

This invention concerns the control of the operation of a paper machine headbox. By headbox it is meant the device which assures the projecting of a paper pulp onto a wire or between wires at the front end of a paper machine, whether said device actually has the appearance of a box or whether it has any other shape, such as for instance that of a plurality of channels, namely a so-called "multi-channel" box.

The parameters such as the speed of the jet of pulp emerging from the headbox, the concentration of the pulp, and the rate of flow of material are determinative of the properties of the paper which is finally obtained. Thus, it has been attempted to effect automatic adjustments of these parameters.

Thus, for instance, in the so-called air cushion headboxes there has been provided a first adjustment of the level of the dilute pulp in the box and of the speed of the jet and a second adjustment the object of which is to maintain at constant value either a ratio or a difference between the speed of the jet of pulp and the speed of movement of the wire of the paper machine. This is true, for instance, in the installation described in U.S. Pat. No. 3,661,701.

Said first adjustment may comprise the control of a valve for the introduction of air into the box by a monovariable controller which receives as input information a level set point information and a level measurement information which is supplied by a level sensor, and the control of the pump supplying the box with dilute pulp by a monovariable controller which receives as input information a jet speed set point information and a jet speed measurement information given, after transformation of the signal, by a sensor of the total pressure present in the box.

It has furthermore been proposed, since the effects of these two controls are not independent of each other, to effect a decoupling by causing the control signal of each controller to act also on the other controller so as to obtain a compensation of the effect exerted by the first controller on the magnitude the measurement of which is to control the other controller.

The second control maintains a constant ratio between the speed of the wire and the speed of the jet of pulp. A wire speed information and a jet speed information are detected, the ratio of these two data is formed and this ratio is sent, at the same time as a set point, to a controller which acts on one of the actuators, that relating to the admission of air or that relating to the fan pump, either directly or indirectly by determining the set point of another controller which is then the level controller or the jet speed controller referred to above.

The second control may, in the same manner, maintain constant not the ratio between the wire speed and the speed of the jet but the difference between these two variables.

A third control is assigned to the basis weight and moisture. It comprises two measurement sensors generally combined in the same head, located downstream of the drying section which follows the headbox, the wet section, and the press section of the paper machine, and two sensors receiving at the input basis weight set point and a moisture set point and the measurement signals supplied by these sensors sending two control signals on the one hand to a thick-stock valve located upstream of the fan pump or possibly to a set point of a local control of this pulp flow and on the other hand either to at least one steam valve or possibly the pressure control set point or to the device adjusting the speed of the machine.

One frequently also finds a feed forward correction of variation of the consistency of the thick pulp which modifies the rate of flow of pulp as a function of this consistency. This correction is currently referred to as "dry stock control".

Other monovariable controls have been developed each acting on a given parameter. In U.S. Pat. No. 3,703,436, one of these controls relates to the slice opening and, with the use of a computer, this control acts only on the slice actuator.

In the article, "Computer Control of Paper-Making Plant" by A. W. Sidebottom, Proc. IEE Vol. 116, No. 10, October 1969, pages 1755 to 1758, a paper machine installation employs a computer which acts at different points of the manufacturing line but always in accordance with a conventional monovariable control system.

In the article entitled "Control of a Paper Machine Using an Analogue Computer", by Sharp and Farmer, published in "Instrument Practice" for January 1970, Vol. 24, No. 1, pages 31 to 34, published by Industrial Trade Press London, a system operates in a closed loop with a computer but it nevertheless remains a conventional basis weight and moisture control system acting on the actuators in accordance with the set points given by the operator of the machine.

In the article "Paper Machine Regulatory Coordinated Control System" in Product Licensing Index No. 73 of May 1970, pages 12 to 15, published by Industrial Opportunities, HAVANT (Great Britain), there is contemplated a decoupling of two controls, but the system described remains a monovariable control system.

These known control systems have serious drawbacks. For example, the control of the basis weight takes into account information obtained at the dry end of the machine while it acts at the head of the machine, for instance on the stock valve. There is therefore a relatively long time lag, which is even more disturbing as the measurement are not available at every moment. Thus it is not possible to eliminate rapid variations in basis weight which occur, for instance, in periods of time of less than 1 minute.

Another difficulty relates to the fact that one is confronted by a process having very strong couplings between the different parameters. In particular, the hydraulic control can cause a deterioration of the substance flow rate.

Now if one can, by a decoupling of the loops such as for instance that mentioned above of the level and jet speed control loops, avoid phenomena of instability of these two loops, one cannot, on the other hand, consider extending this system to more than two variables, without having to establish equipment of excessive size and complexity.

The present invention is based on an entirely different concept of control.

The invention thus proposes, in a system for the control of a paper machine headbox having sensors for the measurement of the parameters of the process and actuators of the process, functionally connecting at least most of the sensors to an at least equal number of actuators via a multivariable centralized control device which makes it possible to control each actuator by the taking into account and processing of the measurement information of one or more sensors, and causing the measurement information from each of the sensors functionally connected to the actuators to act on one or more actuators so as to obtain a resultant action in which only the parameter measured by this sensor is influenced while the secondary repercussions on the other parameters are eliminated.

In accordance with another important characteristic, the invention permits rapid intervention taking into account the information on the substance flow rate at the headbox, eliminating the usual disturbing influences due to the hydraulic variables of the process.

This information can be calculated on the basis of a measurement of the concentration in the headbox, which measurement can be supplied by a conventional continuous concentration sensor, the master role played by the basis weight sensor of later action making it possible to compensate for the errors inherent in such apparatus.

It will be noted in this connection that in none of the documents previously cited was it contemplated to measure the substance flow rate at the outlet of the headbox nor the concentration of the pulp in the headbox.

On the other hand, if at least one monovariable local control already exists on the machine in question, one can advantageously enter into the multivariable centralized control device, as a measurable disturbance, a measurement information of the parameter affected by this monovariable local control.

It is also advantageous to enter into the centralized control device, as a measurable disturbance, information as to the thick stock consistency.

One thus can, as a safety measure, maintain, alongside the multivariable centralized control device, monovariable local controls which do not enter into normal operation but which are placed in operation by switching in case of failure of the centralized control device.

It can also be contemplated that these monovariable local controls operate permanently, the centralized control device acting on the set point of these local controls.

Other characteristics and advantages of the invention will become evident from the embodiments which will be described with reference to the accompanying drawing, in which:

FIG. 1 shows an entire headbox of a paper machine,

FIG. 2 shows synoptically the control system in accordance with the invention,

Figure 6:
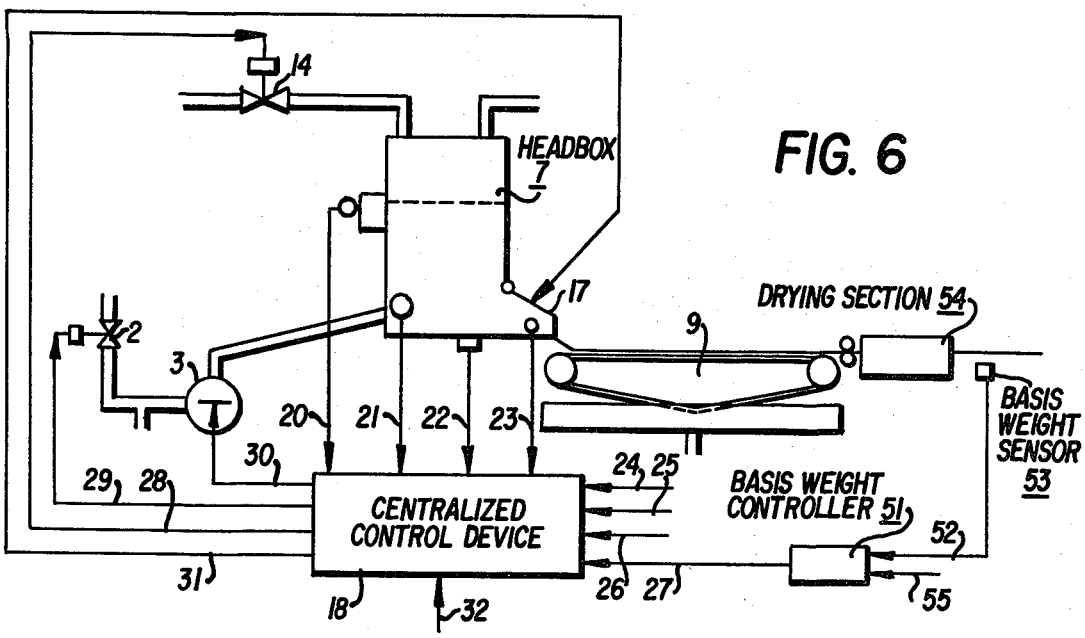
Figure 7:
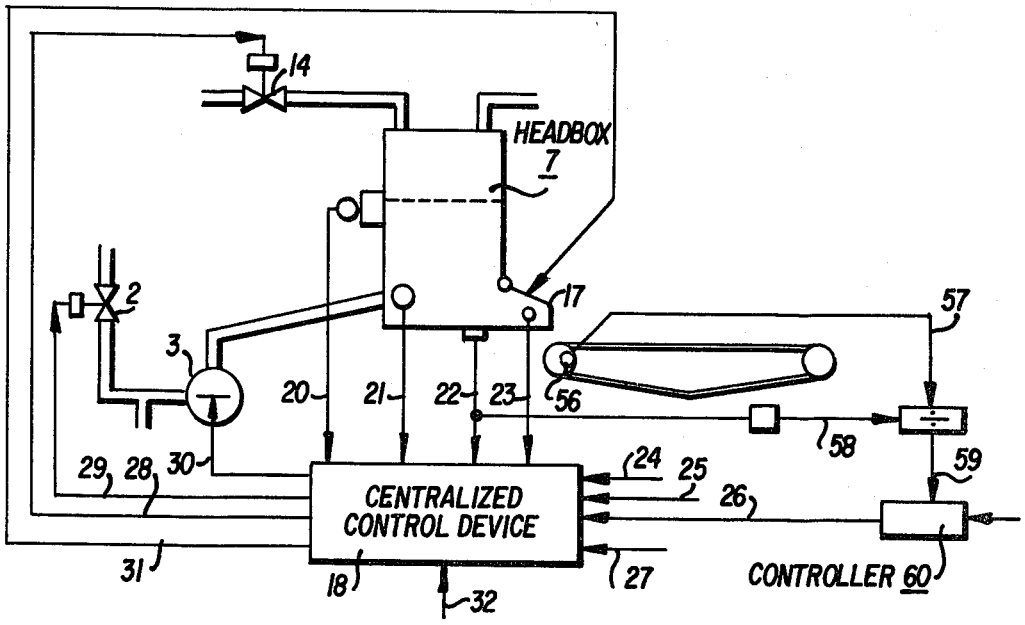
Figure 8:
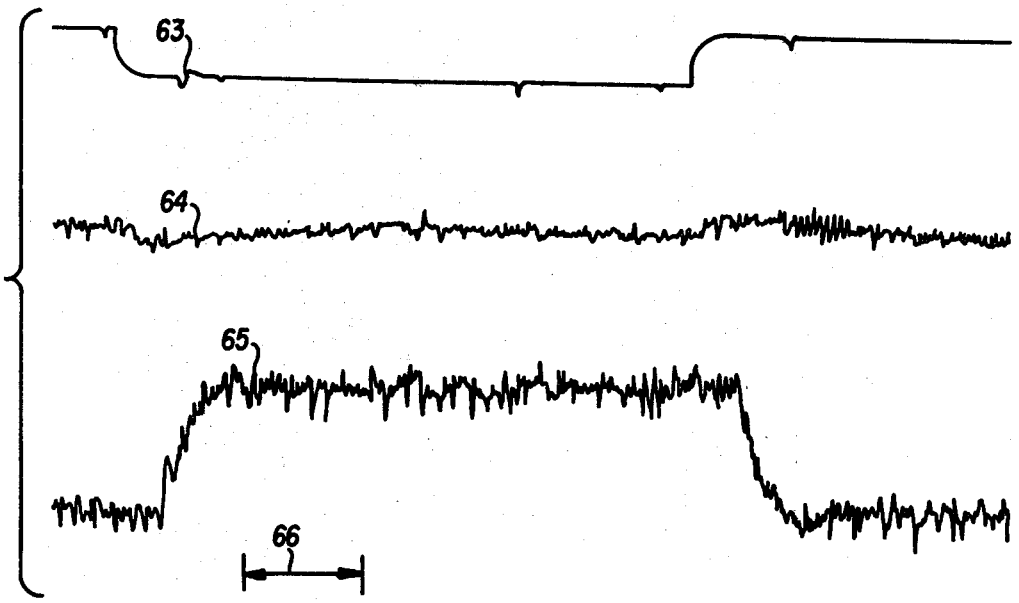
Figure 9:
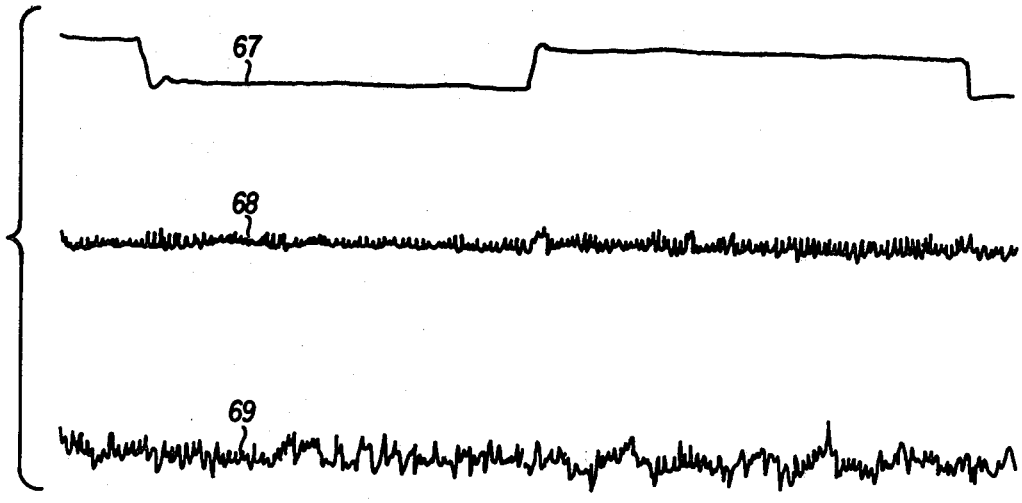
Figure 12:
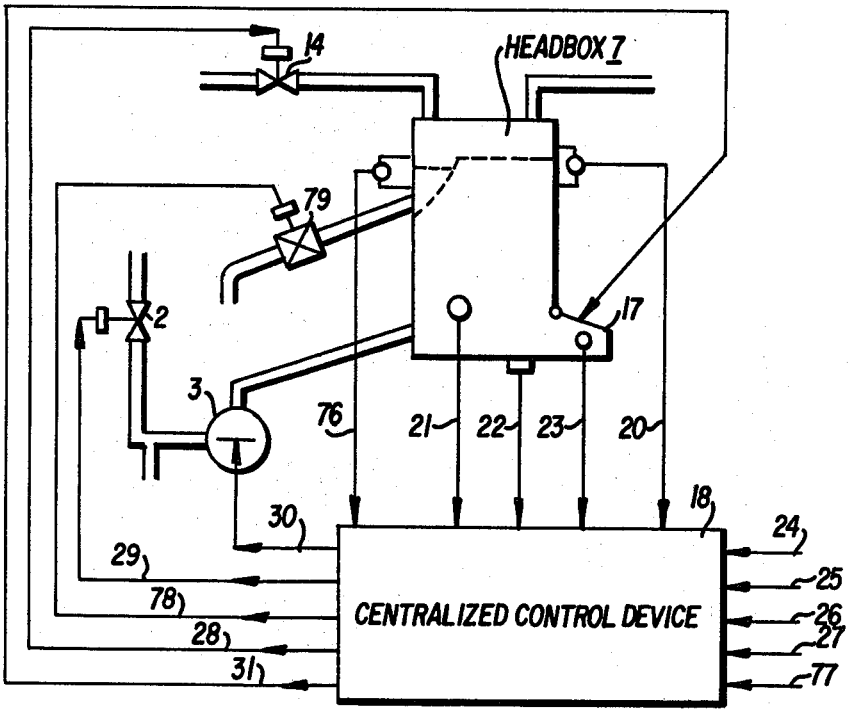
Figure 13:
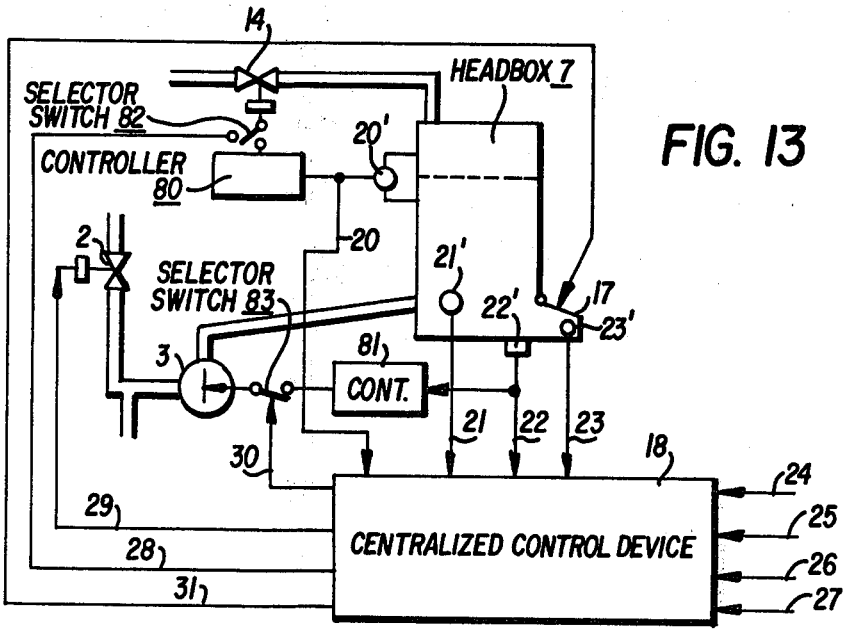
Figure 14:
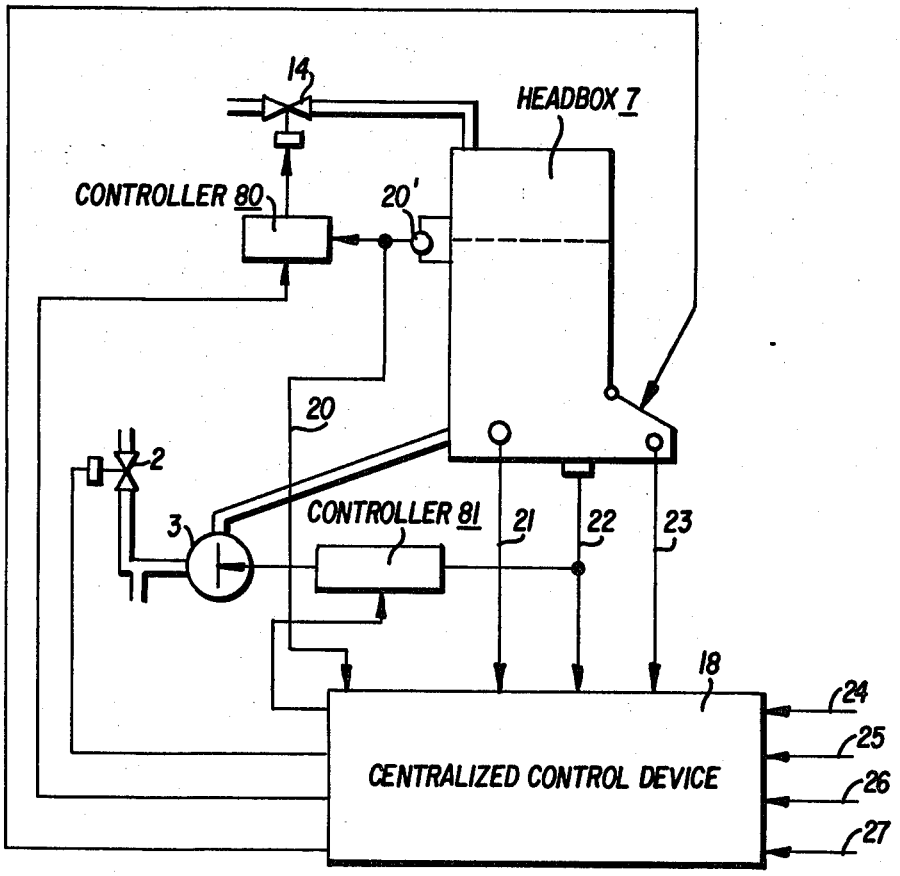

FIG. 3 shows an example of a multivariable control system in which the various signals have been separated, FIG. 4 shows an example of a multivariable centralized control device used in this control system, FIG. 5 shows another example of a multivariable centralized control device, FIG. 6 shows a multivariable control system with adjustment of the basis weight, FIG. 7 shows a multivariable control system with adjustment of the speed of the jet with respect to the speed of the wire, FIGS. 8 and 9 show fluctuations recorded in the case of a conventional control and in the case of the control in accordance with the invention, respectively, FIG. 10 shows a multivariable control system in the case that the slice opening is not automatically controlled, FIG. 11 shows a multivariable control system in the event that the level in the box is maintained by a monovariable control loop, FIG. 12 shows a multivariable control system in the case of an headbox with overflow, and FIGS. 13 and 14 show a multivariable control system combined with monovariable controls.

In FIG. 1 there has been shown schematically an entire conventional headbox into which pulp arrives via a pipe 1 provided with stock valve 2 and is entrained, after dilution, by a fan pump 3 into a pipe 4 which connects with a cleaner 5 connected by a pipe 6 to a headbox 7, from where the diluted pulp emerges at 8 in a jet which projects it onto an endless wire 9 driven at high speed, below which a pit 10 recovers the drainage water, this wet section being followed by a press section and a dry section, which have not been shown in this figure. An air cushion 11 is formed in the headbox 7 by air supplied by a blower pump 12 into a pipe 13 provided with an air valve 14. A recycle pipe 15 provided with a recycle valve 16 is mounted in parallel with the fan pump 3.

Four actuators are provided to effect adjustments: an actuator $U_1$ which controls the stock valve 2; an actuator $U_2$ which controls the speed of rotation of the fan pump and/or the recycle valve 16 (which will be referred to simply as pump actuator); an actuator $U_3$ which controls the speed of the blowerpump 12 and/or the air valve 14 (which will be called simply the air-valve actuator); and an actuator $U_4$ which controls the opening of a slice 17 located on the outlet 8.

The conventional controls consist in providing a plurality of monovariable control loops each of which comprises one of the actuators and a measurement sensor for example one loop comprises a sensor detecting the level of pulp in the headbox 7 and a controller acting on the air valve 14, another loop comprises a sensor detecting the total pressure in the headbox 7 and a controller acting on the speed of the motor of the fan pump 3, and yet another loop comprises a basis weight sensor arranged at the output of the drying section (not shown) and a controller acting on the stock valve 2.

Contrary to this, in accordance with the invention, and as shown in FIG. 2, a multivariable centralized control device 18 is provided which receives at least most of the parameter measurement information given by the sensors which information has been diagrammatically indicated by the output vector Y, as well as all the corresponding set point information indicated diagrammatically by the set point vector Z and which sends multiple orders indicated diagrammatically by the vector U, to actuators of the process 19 which is formed by the headbox and its related parts. There has furthermore been provided entering into the device 18 of measurable disturbances diagrammatically indicated by the vector P. These disturbances concern parameters which act on the outputs Y, but which can be measured. The invention makes it possible to compensate for these disturbances in advance, before their effect is received on the outputs Y.

In FIG. 3 there is shown an example of components of the vectors Y, Z and U. The vector Y comprises information 20 concerning the level of dilute pulp in the headbox, given by a sensor 20', information 21 concerning the concentration of dilute pulp in the headbox given by a sensor 21', information 22 concerning the total pressure in the headbox (or speed of jet), given by a sensor 22', and information 23 concerning the opening of the slice 17 given by a sensor 23'. The vector Z comprises a set point 24 concerning the level in the headbox, a set point 25, concerning the concentration which is modified in accordance with the quality of the formation of the sheet (look-through) and the rapidity of drainage on the wire (position to the water line), a set point 26 concerning the speed of jet which is modified upon the optimization of the speed the machine and upon a grade change, and a set point 27 as to substance flow rate at the slice which is modified upon the control of the basis weight and upon a grade change. The vector U comprises an order or signal 28 controlling the air valve actuator 14, an order 29 controlling the stock valve actuator 2, an order 30 controlling the pump actuator 3, and an order 31 controlling the slice opening actuator 17. In this case the vector P has been limited to a single component 32 which is information concerning the thick pulp consistency. This information 32 which acts as a measurable disturbance can be introduced in all the following diagrams, in which it has not always been included, for reasons of simplification. It goes without saying that one can also use as the measurable disturbance any other component which is capable of being measured and capable of action on the outputs.

In this system, the measurement information given by a sensor may act, not as in conventional systems simply on a corresponding actuator or possibly two actuators, but on all the actuators the action of which is necessary, and do so in desired manner so that only the variable measured by said sensor is influenced.

For this purpose there is established a mathematical model of the process 19 as a function of the performances which it is desired more particularly to obtain. In the tests carried out, mathematical models were developed in particular in the form of discrete state variables.

In FIG. 4 there is shown an example of a control system in accordance with the invention. An action internal model 33 (for instance having the following inputs: stock valve, pump speed, air valve, slice opening) is put in parallel with the process 19 and it receives the same signals U(k) as the latter. This action model 33 is defined by the following conventional relationships between the input U(k), the states X and the outputs Y:

$$X(k+1)=A.\ X(k)+B.\ U(k)$$

$$Y(k+1)=C.\ X(k)$$

in which A is a square output matrix of dimensions n.n, and B and C are matrices whose dimensions depend on the number of inputs and outputs. The matrices, A, B, C can be obtained directly by identification from input and output data of the process or from results of mathematical knowledge models such as, for instance, those in the article by P. A. A. Talvio entitled "A Study of Paper Machine Headbox Control System with Linear Transfer Functions", IFAC Congress London, 1966—Session 22—paper 22A and in the dissertation by A. Barraud: "Minimal Realization and Optimal Approximation of Invariant Linear Dynamic systems" (Dissertation for Degree of Doctor of Sciences—January 1978—ENSN Automation Laboratory Nantes).

An internal model of measured disturbances 34 is put in parallel with the process 19 and it receives the same measured disturbances Up(k) as the process 19 (for instance, i.e., thick-pulp consistency signal and possibly a measured variable used in a monovariable control). This model, also represented in discrete state variables, is of the same type as the model of action, and it can be obtained in the same manner.

The output signals Y(k) and Yp(k) respectively of the action model 33 and the disturbance model 34 are added in an adder 35 and the result of this addition is compared with the output signals Ys (k) of the process (for example, level, concentration of dilute pulp, speed of jet calculated on basis of the total pressure or measured directly, and rate of substance flow rate calculated on basis of the speed of the jet, the concentration and the slice opening) in a comparator 36 whose output constitutes the error signals E(k). These signals E(k) are transmitted to a regulation reference model 37 whose output is transmitted to an adder 38. This adder 38 also receives the output of a tracking reference model 39 receiving at its input the set points Z(k); the adder 38 also receives the output Yp(k) of the measured disturbances model 34. The regulation reference model 37 and the tracking referece model 39 are selected in such manner that the system is decoupled. If a representation in state variables is selected, the matrices A, B and C are diagonal.

The output Yd (k) of the adder 38 is sent to an adder 40 (which gives U(k) at the output) via a matrix KYd 41 and an adder 42 receiving, in order to stabilize the system, the output U(k) of the adder 40 via a device 43 with delay $\Delta T$ and a matrix KUl 44. The adder 40 receives the output X(k) of an adder 45 which receives the output of an action model 33 after being multiplied in a matrix KX 46. Furthermore, the error signals E(k) are used to produce an anticipating action on the one hand by being transmitted by a matrix KE 47 to the adder 45 and on the other hand by entering into the action model 33 via a matrix KES 48. This structure of a control system combining two internal parallel models (33 and 34), a regulation reference model 37 and a tracking reference model 39 provides two main advantages:

(A) It is not necessary to estimate the state variables so any observer or Kalman filter is not required.

(B) The use of different models for tracking and regulation makes it possible to choose different dynamic performances for the tracking and the regulation. The use of models according to the structure is not taught by the prior art and the resulting advantages are not provided to any of the known control systems.

In the examples cited, the calculation of the matrices KX, KYd, KUl, KE, KES is based on the theory of optimal control by minimization of a quadratic criterion on a receding horizon.

FIG. 5 shows another embodiment of the control system in which one again finds most of the members of FIG. 4 except that some of them have been replaced by a calculation block 49 which receives on the one hand at 50 information concerning the constraints such as the limit variations of the actuators and outputs and the speed of variation of these actuators and outputs and, on the other hand, the outputs Yd(k) of the adder 38, U (k-1) of the delay device 43 and X(k) of the action model 33, and which supplies the control signals U(k). In the event that the system is not under constraint, this block realizes the functions represented in FIG. 4, that is to say the products of the matrices 41-44, 46-47 and the additions of the adders 40, 42, 45.

In the event that the system is under constraint, the optimization of the quadratic criterion is obtained by the use of non-linear programming methods such as the relaxation method, the modified gradient method, or the method of Frank and Wolf.

The system forming the object of the invention as just described makes it possible to take into account as a whole, for instance, four inputs and four outputs of the process and to decouple the outputs so as to be able to change the four outputs independently of each other and with the desired response. This system can take into account disturbing variables which are measurable by means of sensors as well as constraints on the actions and on the outputs, in particular constraints of amplitude and speed of variation (for instance the speed of rotation of a slice-opening motor).

This system is easily integrated in the existing process controls such as the control of the basis weight and the moisture, the control of the ratio or the difference of jet speed/wire speed, and the optimizing of the production. Taking into account the concentration at the headbox by means of an optical sensor makes it possible to calculate the substance flow rate from the measurement of the concentration, the slice opening and the total pressure, and thus to have a picture of what the basis weight will be at the end of the machine.

In FIG. 6 a basis weight control diagram has been shown by way of example. This diagram includes the system of FIG. 3 in which the substance flow rate set point 27 is supplied by a basis weight controller 51 which receives, at 52, measurement information from a basis weight sensor 53 located downstream of the drying section 54 and basis weight set point information 55. The basis weight controller thus controls the substance flow rate set point but the control of the substance flow rate takes place locally with a rapid response due to the installation of an optical concentration sensor, which apparatus has up to now been considered as not to be used due to the fact that it can undergo measurement shifts while on the contrary it has been found that in the tests carried out in accordance with the invention these shifts were without importance since the control by the basis weight controller automatically provided for the necessary corrections.

In FIG. 7 there is shown an example of control of the jet speed with respect to the wire speed. One thus again has the system of control of FIG. 3, but there has been added a wire-speed sensor 56 whose measurement information 57 divides or subtracts the jet-speed information 58 deducted from the total pressure information 22 to give a value 59 of the ratio or difference of jet speed to wire speed which enters into a controller 60 receiving at 61 set point information $\rho_o$ and supplying at 62 set point 26 for jet speed (or total pressure in the headbox). For the sake of greater clarity there have been shown in separate figures (FIGS. 6 and 7) the control of basis weight and the control of the ratio or difference of jet speed to wire speed, but it is obvious that these two controls can and will generally be run jointly.

The system in accordance with the invention has great stability and permits excellent decoupling of the different output variables of the process as well as a selection of the rapidity of response of these output variables. Tests were carried out by changing the total pressure set point and there were observed the repercussions which this produced on the level and concentration in the headbox. The result obtained with two monovariable control loops is shown in FIG. 8, in which there has been entered at 63, the variation of the total pressure, at 64 the variation of the level, and at 65 the variation of the concentration as a function of the time, the vector 66 indicating a period of one minute. The result obtained with the multivariable system of the invention is shown in FIG. 9, in which there is shown at 67 the variation of the total pressure, at 68 the variation of the level, and at 69 the variation of the concentration. One can thus note the interaction on the level and in particular on the concentration in the conventional control while when applying the invention a perfect decoupling of the output variables of the process has been effected.

A few variant embodiments of the multivariable control system of the invention will now be indicated.

It has already been shown that one could introduce into the control device 18 information 32 concerning the thick-pulp consistency, which information is supplied by a consistency sensor located on the thick-pulp supply tank. A feed forward action is thus obtained.

In certain paper machines, the slice opening is not effected by a motor or else one cannot continuously control the slice opening (for reasons of mechanical endurance, for instance). In this case, one cannot consider the slice opening as an actuator and one has a process with three inputs, stock valve, air valve and pump speed, and with three outputs, level, speed of jet (total pressure) and substrate flow rate. Three set points are introduced, namely level 24, speed jet 26, and substance flow rate 27. The multivariable centralized control device 18 takes into account, at 70, a signal measuring the slice opening, as shown in FIG. 10, in order to eliminate its interaction on the level, jet-speed and substance flow outputs.

A diagram which, like that of FIG. 10, comprises a process with three inputs and three outputs can be used in the case of purely hydraulic headboxes, that is to say headboxes without air cushion, the air valve and the measurement of the level being eliminated.

With purely hydraulic headboxes it is known that in order to dampen the pulsations in the hydraulic circuit which feeds a box one can add an air dampener which comprises a feed via an air valve. One can then have the same multivariable control diagram as in the case of a headbox with air cushion, the level and the air valve of the dampener being substituted for those of the headbox.

If one has effected the control of an output variable independently of the multivariable centralized control device, for instance by a monovariable control or by a mechanical means, the multivariable control system can take into account the variation of this output variable in measurable disturbance. Two diagrams of such a system will be given by way of example for the situation where the level in the headbox is controlled independently of the multivariable centralized control device.

In the case of FIG. 11, an analog control of the level in the headbox 7 has been installed by means of a level sensor 71 whose output 72 is compared in a controller 73 with set point 74 to control the air valve 14. The output 72 of the sensor 71 is then sent as measurable disturbance 75 to the multivariable centralized control device 18.

In the case of a headbox with overflow, one can first of all use the air valve as actuator, which makes it possible to improve the precision of the level; one then again finds the multivariable control system for a process with four input variables and four output variables which has been seen above. One could also introduce the measured level information into the multivariable centralized control device as measurable disturbance, as has just been seen. Furthermore, the level in the reverse can be considered as a fifth output variable and the reverse flow valve as a fifth actuator. FIG. 12 shows this last solution in which the control device 18 receives the information 20 as to level in the headbox, 21 as to concentration, 22 as to total pressure, and 23 as to slice opening and also as to level in the reverse 76. In addition to the set point 24 as to level in the box, 25 as to concentration, 26 as to jet speed, and 27 as to substance flow rate, a level set point 77 enters into the reverse. The control orders comprise, in addition to the orders 28 to 31 concerning an air valve, stock valve, pump, and slice opening respectively, a control 78 which actuates the reverse rate-of-flow valve 79.

In certain types of headbox with air cushion or a purely hydraulic box with air dampener, the level is maintained by overflow in a hole (so-called Hornbostel hole) the shape and dimensions of which are such as to obtain automatic control of the level. One can then, in particular, adopt one of the following three solutions. First, one can not measure the level in the box and content oneself with taking into account three input variables and three output variables of the process. A second solution comprises improving this first solution by taking into account the variation in level as a measurable disturbance in the multi-variable centralized control device. A third solution comprises superimposing on the Hornbostel hole a level control incorporated in the multivariable constrol system as has been seen above and acting on the air valve to improve the precision on the level and eliminated the level/total-pressure interaction.

It has been seen that with the invention one has a very flexible system which can be adapted to the specific requirements of operation.

For reasons of reliability of operation of the installation in case of breakdown of the multivariable control system, one may retain monovariable control loops at least for the hydraulic variable level and total pressure. One can then, in a first solution which is shown in FIG. 13 in which there is again present a multivariable centralized control device 18 such as that shown in FIG. 3, consider these control loops (level sensor 20', controller 80, air valve 14 and pressure sensor 22', controllor 81, pump 3) as emergency loops which are put in operation when a failure of the multivariable centralized control device is indicated, for instance by a "watch dog". It is sufficient to provide a system of selector switches 82, 83 to connect actuators no longer in normal operation to the multivariable centralized control device, but to the corresponding controllers of the monovariable control loops.

A second solution comprises permanently using these monovariable control loops, the multivariable centralized control device then acting not directly on the actuators of these loops but on the set points of the controllers of the monovariable control loops. FIG. 14 shows such a solution. There can be noted therein a multivariable centralized control device 18 such as that of FIG. 3, for instance, in which the control order 28 no longer acts directly on the air valve 14 but on the set point of the controller 80 located in an analog control loop also comprising the level sensor and the air valve 14 and in which the control order 30 no longer acts directly on the pump 3 but on the set point of the controller 81 placed is an analog control loop also comprising the total pressure sensor and the pump 3.

A very large number of variants can be adopted in the carrying out of the invention, depending on the nature of the headbox, the variables measured, the actuators used, and the performances sought. It would appear evident to those skilled in the art to adapt this multivariable control to the features of each installation while remaining within the scope of the present invention.

What is claimed is:

1. An apparatus for controlling a paper machine headbox comprising:

four sensors for directly measuring respective parameters of a paper making process and the disturbance to said parameters caused by operation of said machine, said sensors respectively directly measuring the pulp concentration in the headbox, the pulp level in the headbox, the total pressure in the headbox and a slice opening of the headbox;

at least three actuators having inputs for controlling respective operative devices which affect said measured parameters of the process;

a multivariable control system for receiving output signals from said four sensors and set point values for said measured parameters and supplying control signals to said at least three actuators, said control system comprising:

first means providing a model of said process, said first means receiving setting signals which are applied to said at least three actuators and supplying first parameter output signals representing the interrelationship of said measured parameters with respect to actuator settings as determined by said process model;

second means in parallel with said first means and providing a measurable disturbance model relating to said process, said second means receiving measured disturbance signals and supplying first parameter disturbance signals representing the interrelationship of parameter disturbances with respect to measured disturbances as determined by said disturbance model;

third means providing a regulation reference model relating to said process, said third means being responsive to output signals from said sensors and said first and second means and providing output signals for eliminating said measured disturbances as determined by said regulation reference model; and, fourth means providing a tracking reference model relating to said process, said fourth means receiving set point values for said measured parameters and providing therefrom output signals representing desired values of said measured parameters of said process as determined by said tracking reference model;

said control system providing individual control signals to said actuators in response to said sensor signals and the output signals of said first, second, third and fourth means for controlling at least one parameter of said process in direct response to a variation in said parameter from a disturbance, set point change, or both, by altering the inputs to said actuators, while minimizing the effects on the remainings parameters of said process.

2. An apparatus according to claim 1, further comprising a basis weight sensor means at the end of a drying section located downstream of the headbox, and a basis weight controller connected to said basis weight sensor for introducing into said multivariable control system a signal which controls a set point for the flow of material at the outlet of the headbox.

3. An apparatus according to claim 2, further comprising a moisture sensor at an end of said drying section of said paper machine, which includes means responsive to the basis weight and moisture measurements and an actuator controlling the speed of the machine, for introducing into said multivariable control system a signal for controlling the substance flow rate at the outlet of the headbox.

4. An apparatus according to claim 1, further comprising means responsive either to an output signal of said sensor measuring the total pressure in said headbox or to an output signal of an additional sensor measuring the speed of a jet in said headbox and to a signal representing the speed of a wire at the outlet of the headbox, for providing a ratio or difference between said output signal and said speed signal and supplying said ratio or difference to a controller for providing a set point as to total pressure or speed of the jet to said multivariable control system.

5. An apparatus according to any of claims 1, 2, 3 or 4, wherein four actuators are provided which respectively act on an inlet stock valve in a pulp supply path of said headbox, on a pulp supply pump in said supply path, on a valve for the admission of air above the pulp level in said headbox and on a slice control of the outlet of said headbox.

6. An apparatus according to any of claims 1, 2, 3 or 4, wherein one of said parameters is controlled independently of said multivariable control system and a measurement signal of said one parameter is introduced into said multivariable control system as a measurable disturbance.

7. An apparatus according to claim 6, wherein the headbox outlet has at its outlet a slice the opening of which is not controlled by the multivariable centralized control system and wherein said actuators act on an inlet stock valve in a pulp supply path to said headbox, on a pulp supply pump in said supply path, and on a valve governing air admitted into the headbox, and a signal responsive to the slice opening is introduced into said multivariable control system as a measurable disturbance.

8. An apparatus according to claim 6, wherein the control of the level in the headbox is effected independently of the multivariable control system, and the actuators act on an inlet stock valve in a pulp supply path of said headbox, on a pulp supply pump in said supply path, and on a slice opening controller, and a signal responsive to the pulp level in the headbox is introduced into said multivariable control system as a measurable disturbance.

9. An apparatus according to claim 5, wherein the headbox has an overflow and further comprising a sensor for measuring the level in the overflow and an actuator acting on a reverse flow valve.

10. An apparatus according to claim 1, comprising in addition to said multivariable control system, at least one monovariable control means to which the corresponding actuators which are normally controlled by said multivariable control system are switched in case of a breakdown of the latter.

11. An apparatus according to claim 1, which further comprises at least one monovariable control means responsive to said multivariable control system.

12. An apparatus according to claim 1, including means for introducing a thick-pulp consistency value into the multi-variable control system as a measurable disturbance.

* * * * *